US012297396B2

(12) United States Patent
Harhausen et al.

(10) Patent No.: US 12,297,396 B2
(45) Date of Patent: May 13, 2025

(54) EMULSIFIER PACKAGE WITH QUATERNARY AMMONIUM SURFACTANT FOR FUEL EMULSION

(71) Applicant: BASF SE, Ludwigshafen am Rhein (DE)

(72) Inventors: Marcel Harhausen, Ludwigshafen (DE); Thorsten Schoeppe, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 18/464,694

(22) Filed: Sep. 11, 2023

(65) Prior Publication Data

US 2023/0416628 A1 Dec. 28, 2023

Related U.S. Application Data

(63) Continuation of application No. 17/608,360, filed as application No. PCT/EP2020/061317 on Apr. 23, 2020, now Pat. No. 11,788,024.

(30) Foreign Application Priority Data

May 3, 2019 (EP) ..... 19172458

(51) Int. Cl.
*C10L 1/32* (2006.01)
*C10L 1/14* (2006.01)
*C10L 1/222* (2006.01)

(52) U.S. Cl.
CPC ..... *C10L 1/328* (2013.01); *C10L 1/143* (2013.01); *C10L 1/2225* (2013.01); *C10L 2250/084* (2013.01)

(58) Field of Classification Search
CPC ..... C10L 1/328; C10L 1/143; C10L 1/2225; C10L 2250/084; C10L 1/1985; C10L 2250/08; C10L 2250/082; C10L 2270/026; C10L 10/04; C10L 1/2222
See application file for complete search history.

(56) References Cited

U.S. PATENT DOCUMENTS

| | | | | |
|---|---|---|---|---|
| 3,876,391 | A | 4/1975 | Mccoy et al. | |
| 4,388,893 | A | 6/1983 | Apfel | |
| 4,395,266 | A | 7/1983 | Han | |
| 5,551,956 | A | 9/1996 | Moriyama et al. | |
| 5,834,539 | A | 11/1998 | Krivohlavek | |
| 2004/0020105 | A1* | 2/2004 | Burrington | C10L 1/10 44/301 |
| 2008/0113890 | A1 | 5/2008 | Moreton et al. | |
| 2010/0257779 | A1 | 10/2010 | Barton et al. | |
| 2018/0251692 | A1 | 9/2018 | Mezger et al. | |

FOREIGN PATENT DOCUMENTS

| | | |
|---|---|---|
| DE | 2443537 | 3/1975 |
| DE | 19747240 | 7/1998 |
| DE | 19747247 | 7/1998 |
| WO | 90/12959 | 11/1990 |
| WO | 94/03560 | 2/1994 |
| WO | 00/53916 | 9/2000 |
| WO | 2006/135881 | 12/2006 |
| WO | 2008/060888 | 5/2008 |
| WO | 2010/105620 | 9/2010 |
| WO | 2010/132259 | 11/2010 |
| WO | 2010/145652 | 12/2010 |
| WO | 2012/004300 | 1/2012 |
| WO | 2013/000997 | 1/2013 |
| WO | 2016/064722 | 4/2016 |
| WO | 2017/009208 | 1/2017 |
| WO | 2017/077302 | 5/2017 |

OTHER PUBLICATIONS

European Search Report for EP Patent Application No. 19172458.2, Issued on Nov. 8, 2019, 3 pages.
International Search Report for PCT Patent Application No. PCT/EP2020/061317, Issued on Aug. 6, 2020, 3 pages.

* cited by examiner

*Primary Examiner* — Cephia D Toomer
(74) *Attorney, Agent, or Firm* — Grüneberg and Myers PLLC

(57) ABSTRACT

A fuel emulsion for powering a diesel engine contains water, a fuel, and an emulsifier package containing a quaternary ammonium surfactant. A method for powering a diesel engine with the fuel emulsion involves preparing the fuel emulsion by emulsifying a fuel and water in the presence of the emulsifier package. An emulsifier package for emulsifying a fuel and water contains a quaternary ammonium surfactant and at least one nonionic surfactant, which is an alkoxylate. The quaternary ammonium surfactant is obtainable by reacting a quaternizable nitrogen compound containing at least one quaternizable, especially tertiary, amino group with a quaternizing agent, which converts the at least one quaternizable, especially tertiary, amino group to a quaternary ammonium group, where the quaternizing agent is a hydrocarbyl epoxide in combination with a free hydrocarbyl-substituted polycarboxylic acid.

16 Claims, No Drawings

EMULSIFIER PACKAGE WITH QUATERNARY AMMONIUM SURFACTANT FOR FUEL EMULSION

CROSS-REFERENCE TO RELATED APPLICATIONS

This application is a continuation of U.S. application Ser. No. 17/608,360, filed on Nov. 2, 2021, which was the National Stage entry under § 371 of International Application No. PCT/EP2020/061317, filed on Apr. 23, 2020, and which claims the benefit of priority to European Application No. 19172458.2, filed on May 3, 2019. The content of each of these applications is hereby incorporated by reference in its entirety.

The present invention relates to a fuel emulsion for powering a diesel engine comprising water, a fuel, and an emulsifier package, which comprises a quaternary ammonium surfactant. It further relates to a method for powering a diesel engine with the fuel emulsion comprising the step of preparing the fuel emulsion by emulsifying a fuel and water in the presence of the emulsifier package; and to an emulsifier package for emulsifying a fuel and water comprising a quaternary ammonium surfactant which is obtainable by reacting a quaternizable nitrogen compound comprising at least one quaternizable, especially tertiary, amino group with a quaternizing agent which converts the at least one quaternizable, especially tertiary, amino group to a quaternary ammonium group, where the quaternizing agent is a hydrocarbyl epoxide in combination with a free hydrocarbyl-substituted polycarboxylic acid, and at least one nonionic surfactant which is an alkoxylate.

Aqueous fuel emulsions are known for powering diesel engines.

Object of the present invention was to find an emulsifier package for fuel emulsions, which is cheap, easy to prepare, storage stable, based on commercial available emulsifiers, based only on carbon, hydrogen, nitrogen and oxygen, and allow for fast and easy emulsification even with low shear forces. The emulsifier package should result in a low foaming fuel emulsion, it should have a low cloud point, provide corrosion protection, have low foaming, improve filterability of the emulsion, and reduce precipitate when mixing the fuel with water. The emulsifier package should stabilize the fuel emulsion at high water concentrations, at various temperatures and pressures, with various types of water.

The object was achieved by a fuel emulsion for powering a diesel engine comprising

- water,
- a fuel, and
- an emulsifier package, which comprises a quaternary ammonium surfactant.

The object was also achieved by an emulsifier package for emulsifying a fuel and water comprising

- a quaternary ammonium surfactant which is obtainable by reacting a quaternizable nitrogen compound comprising at least one quaternizable, especially tertiary, amino group with a quaternizing agent which converts the at least one quaternizable, especially tertiary, amino group to a quaternary ammonium group, where the quaternizing agent is a hydrocarbyl epoxide in combination with a free hydrocarbyl-substituted polycarboxylic acid, and
- at least one nonionic surfactant which is an alkoxylate.

The fuel usually comprise hydrocarbons, such as alkanes, cycloalkanes and aromatics. The fuel may be obtained from petroleum distillation as destillate or residue. The fuels is usually a liquid fuel. Examples of fuels are gasoline, diesel or biodiesel or mixtures thereof, wherein gasoline or diesel are preferred. In particular the fuel is diesel. The gasoline may contain mainly C4 to C12 hydrocarbons of alkanes, alkenes and cycloalkanes. The diesel may contain saturated hydrocarbons and aromatic hydrocarbons. The biodiesel typically includes lower alkyl fatty acid esters, prepared, for example, by transesterifying trigycerides with lower alcohols, e.g. methanol or ethanol.

The viscosity of the fuel can vary in a broad range, such as in the range from 1 to 10,000 $mm^2/s$ at 40° C. (ISO 3104) or 1 to 1000 $mm^2/s$ at 50° C. (ISO 3104).

The fuel may be a marine fuel, such as MGO (Marine gas oil), MDO (Marine diesel oil), IFO (Intermediate fuel oil), MFO (Marine fuel oil), or HFO (Heavy fuel oil). Further examples for marine fuel are IFO 380 (an Intermediate fuel oil with a maximum viscosity of 380 centistokes (<3.5% sulphur)), IFO 180 (an Intermediate fuel oil with a maximum viscosity of 180 centistokes (<3.5% sulphur)), LS 380 (a Low-sulphur (<1.0%) intermediate fuel oil with a maximum viscosity of 380 centistokes), LS 180 (a Low-sulphur (<1.0%) intermediate fuel oil with a maximum viscosity of 180 centistokes), LSMGO (a Low-sulphur (<0.1%) Marine Gas Oil, which is to often be used in European Ports and Anchorages according to EU Sulphur directive 2005/33/EC), or ULSMGO (a Ultra-Low-Sulphur Marine Gas Oil, also referred to as Ultra-Low-Sulfur Diesel (sulphur 0.0015% max). Further suitable marine fuels are according to DIN ISO 8217 of the category ISO-F-DMX, DMA, DFA, DMZ, DFZ, or DFB, or ISO-F RMA, RMB, RMD, RME, RMG, or RMK. Further suitable marine fuel is distillate marine diesel or residual marine diesel.

The viscosity of the fuel, such as the marine fuel, can vary in a broad range, such as in the range from 1 to 10,000 $mm^2/s$ at 40° C. (ISO 3104) or 1 to 1000 $mm^2/s$ at 50'C (ISO 3104).

The fuel emulsion may contain at least 10, 20, 25, 30, 35, 40, 50 or 60 wt % of the fuel. The fuel emulsion may contain up to 30, 40, 50 or 80 wt % of the fuel. The fuel emulsion may contain 10 to 70 wt %, 20 to 60 wt %, or 30 to 50 wt % of the fuel.

For ecological reasons low sulfur fuel are of increasing interest. Suitable low sulfur fuels may contain less than 1, 0.5, 0.2, or 0.1 wt % sulfur. An example is Shell® ULSFO with less than 0.1 wt % sulfur. The diesel mainly used for cars may have a sulfur content of up to 2000 ppm, 500 ppm, 350 ppm, 50 ppm or 10 ppm.

Any kind of water can be used, such as tap water, well water, sea water, oceanic water, rain water, distilled water, waste water, or deionized water. Preferred is water with low chlorine concentration to avoid corrosion, such as tap water, distilled water or rain water.

The water may have a low hardness. e.g. as expressed by ° dH (degree of german hardness) below 8.4° dH, or a concentration of less than 1.5 mmol/l calcium carbonate.

The water may have a low salinity, such as up to 1000, 500, 100, 10, or 1 ppmw, e.g. based on the concentration of NaCl.

The fuel emulsion may contain at least 10, 20, 30, 40, 50, 55, 60, 65 or 70 wt % of the water.

The fuel emulsion may contain up to 50, 60, 70, 75, 80, 85 or 90 wt % of the water. The fuel emulsion may contain 30 to 90 wt %, 40 to 80 wt %, or 50 to 80 wt % of the water.

The weight ratio of the water to the fuel can be in the range of 1:0.1 to 1:10, or 1:0.5 to 1:5, or 1:0.7 to 1:3, or preferably 1:0.1 to 1:2.4.

The fuel emulsion can be an oil-in-water emulsion or a water-in-oil emulsion, where the oil-in-water emulsion is preferred.

The fuel emulsion may be a macroemulsion, miniemulsion or microemulsion, where the macroemulsion is preferred.

The dispersed phase (e.g. the fuel) in the fuel emulsion may have a diameter of 0.01 to 100 μm, preferably from 1 to 100 μm.

The fuel emulsion may be present at a temperature from 0 to 100° C., preferably from 15 to 90° C.

The fuel emulsion may be present at a pressure from 1 to 100 bar, preferably from 1 to 10 bar.

The emulsifier package comprises a quaternary ammonium surfactant. Suitable quaternary ammonium surfactants are R'R"R'"R""N+X—, where R', R", R'", and R"" are independently aliphatic or aromatic groups, and X is a halogen (e.g. chloride) or anionic aliphatic or aromatic groups. Examples are alkyl trimethyl ammonium chloride, where R contains 8 to 18 carbon atoms, such as dodecyl trimethyl ammonium chloride; dialkyl dimethyl ammonium chloride, with the alkyl groups having a chain length of 8 to 18 C atoms; N,N-dialkylimidazolinium compounds; and N-alkylpyridinium salts.

The quaternary ammonium surfactant is preferably a reaction product obtainable by reacting a quaternizable nitrogen compound comprising at least one quaternizable, especially tertiary, amino group with a quaternizing agent which converts the at least one quaternizable, especially tertiary, amino group to a quaternary ammonium group, wherein the quaternizing agent is a hydrocarbyl epoxide in combination with a free hydrocarbyl-substituted polycarboxylic acid, and such reaction product is herein after also called "epoxide quaternized amine". Suitable epoxide quaternized amines are described in detail in WO 2017/009208.

The quaternizable nitrogen compound may be selected from a) at least one alkylamine comprising at least one compound of the general formula (3) $R_aR_bR_cN$ (3)
   in which at least one of the $R_a$, $R_b$ and $R_c$ radicals, for example one or two, is a straight-chain or branched, saturated or unsaturated $C_8$-$C_{40}$-hydrocarbyl radical (especially straight-chain or branched $C_8$-$C_{40}$-alkyl) and the other radicals are identical or different, straight-chain or branched, saturated or unsaturated $C_1$-$C_6$-hydrocarbyl radicals (especially $C_1$-$C_6$-alkyl);

b) at least one polyalkene-substituted amine comprising at least one quaternizable, especially tertiary, amino group;

c) at least one polyether-substituted amine comprising at least one quaternizable, especially tertiary, amino group; and d) at least one reaction product of a hydrocarbyl-substituted acylating agent and a compound comprising a nitrogen or oxygen atom and additionally comprising at least one quaternizable, especially tertiary, amino group; and e) mixtures thereof.

In the compounds of the formula (3) preferably all the $R_a$, $R_b$ and $R_c$ radicals are identical or different, straight-chain or branched, saturated or unsaturated $C_8$-$C_{40}$-hydrocarbyl radicals, especially straight-chain or branched $C_8$-$C_{40}$-alkyl radicals. More preferably, at least two of the $R_a$, $R_b$ and $R_c$ radicals are the same or different and are each a straight-chain or branched $C_{10}$-$C_{20}$-alkyl radical and the other radical is $C_1$-$C_4$-alkyl.

The compounds of the formula (3) preferably bears a segment of the formula $NR_aR_b$ where one of the radicals has an alkyl group having 8 to 40 carbon atoms and the other an alkyl group having up to 40 and more preferably 8 to 40 carbon atoms. The $R_c$ radical is especially a short-chain $C_1$-$C_6$-alkyl radical, such as a methyl, ethyl or propyl group. $R_a$ and $R_b$ may be straight-chain or branched, and/or may be the same or different. For example, $R_a$ and $R_b$ may be a straight-chain $C_{12}$-$C_{24}$-alkyl group. Alternatively, only one of the two radicals may be long-chain (for example having 8 to 40 carbon atoms), and the other may be a methyl, ethyl or propyl group. Appropriately, the $NR_aR_b$ segment is derived from a secondary amine, such as dioctadecylamine, dicocoamine, hydrogenated ditallowamine and methylbehenylamine. Amine mixtures as obtainable from natural materials are likewise suitable. One example is a secondary hydrogenated tallowamine where the alkyl groups are derived from hydrogenated tallow fat, and contain about 4% by weight of $C_{14}$, 31% by weight of $C_{16}$ and 59% by weight of $C_{18}$-alkyl groups. Corresponding tertiary amines of the formula (3) are sold, for example, by Akzo Nobel under the Armeen® M2HT or Armeen® M2C name.

The compounds of the formula (3) may also be one where the $R_a$, $R_b$ and $R_c$ radicals have identical or different long-chain alkyl radicals, especially straight-chain or branched alkyl groups having 8 to 40 carbon atoms. The compounds of the formula (3) may also be one where the $R_a$, $R_b$ and $R_c$ radicals have identical or different short-chain alkyl radicals, especially straight-chain or branched alkyl groups having 1 to 7 or especially 1 to 4 carbon atoms. Further examples of suitable compounds of the formula (3) are N,N-dimethyl-N-(2-ethylhexyl)amine, N,N-dimethyl-N-(2-propylheptyl) amine, dodecyl-dimethylamine, hexadecyldimethylamine, oleyldimethylamine, stearyldimethylamine, heptadecyldimethylamine, cocoyldimethylamine, dicocoylmethylamine, tallowdimethylamine, ditallowmethylamine, tridodecylamine, trihexadecylamine, triocta-decylamine, soyadimethylamine, tris(2-ethylhexyl)amine, and Alamine 336 (tri-n-octylamine). Nonlimiting examples of short-chain tertiary amines are: trimethylamine, triethylamine, tri-n-propylamine, tri-n-butylamine, tri-n-pentylamine, tri-n-hexylamine, tri-n-heptylamine, ethyldimethylamine, dimethylethylamine, n-propyldimethylamine, isopropyldimethylamine, n-propyldiethylamine, isopropyldiethylamine, n-butyldimethylamine, n-butyldiethylamine, n-butyldipropylamine. Short-chain triamines are also appropriate especially when the quaternizing agent bears one or more alkyl radicals $R_d$ having more than one carbon atom or one or more aromatic radicals $R_d$.

Suitable quaternizable nitrogen compounds are polyalkene-substituted amines having at least one tertiary nitrogen group. This group of compounds is likewise known and is described, for example, in WO 2008/060888 or US 2008/0113890. Such polyalkene-substituted amines having at least one tertiary amino group are derivable from an olefin polymer and an amine such as ammonia, monoamines, polyamines or mixtures thereof. In another embodiment, the amine of the polyalkene-substituted amines may be a polyamine. The polyamine may be aliphatic, cycloaliphatic, heterocyclic or aromatic. Examples of the polyamines include: alkylenepolyamines, hydroxyl group-comprising polyamines, aryl polyamines and heterocyclic polyamines. The number-average molecular weight of such polyalkene-substituted amines is about 500 to about 5000, for example 1000 to about 1500 or about 500 to about 3000.

Preferred polyalkene-substituted amines are alkylenepolyamines comprise those of the following formula:

$$HN(R^5)\text{-(alkylene-}N(R^5))_n\text{—}(R^5)$$

in which n is in the range from 1 to about 10 and, for example, in the range from 2 to about 7, or from 2 to about 5, and the "alkylene" group has 1 to about 10 carbon atoms, for example 2 to about 6, or 2 to about 4 carbon atoms; the $R^5$ radicals are each independently hydrogen, an aliphatic group, a hydroxyl- or amine-substituted aliphatic group of up to about 30 carbon atoms in each case. Typically, $R^5$ is H or lower alkyl (an alkyl group having 1 to about 5 carbon atoms), especially H.

Alkylenepolyamines of this kind include: methylenepolyamines, ethylenepolyamines, butylenepolyamines, propylenepolyamines, pentylenepolyamines, hexylenepolyamines and heptylenepolyamines. The higher homologs of such amines and related aminoalkyl-substituted piperazines are likewise included. Specific alkylenepolyamines are: ethylenediamine, diethylenetriamine, triethylenetetramine, tetraethylenepentamine, propylenediamine, 3-dimethylaminopropylamine, trimethylenediamine, hexamethylenediamine, decamethylene-diamine, octamethylenediamine, di(heptamethylene)triamine, tripropylenetetramine, pentaethylenehexamine, di(trimethylenetriamine), N-(2-aminoethyl)piperazine and 1,4-bis(2-aminoethyl)piperazine.

Suitable polyether-substituted amines are known from WO2013/064689. Substituted amines of this kind especially have at least one, especially one, polyether substituent having monomer units of the general formula Ic $$\text{—}[CH(R_3)\text{—}CH(R_4)\text{—}O]\text{—} \quad \text{(Ic)}$$

in which $R_3$ and $R_4$ are the same or different and are each H, alkyl, alkylaryl or aryl. The polyether-substituted amine may have a number-average molecular weight in the range from 500 to 5000, especially 800 to 3000 or 900 to 1500.

The polyether-substituted amines are especially nitrogen compounds of the general formula Ia-1 or Ib-2

$$(R_1)(R_2)N\text{—}A\text{—}O\text{—}[CH(R_3)\text{—}CH(R_4)\text{—}O]_n\text{—}H \quad \text{(Ia-1)}$$

$$R_6\text{—}O\text{—}[CH(R_3)\text{—}CH(R_4)\text{—}O]_{n-1}\text{—}CH(R_3)\text{—}CH(R_4)\text{—}N(R_1)(R_2) \quad \text{(Ib-2)}$$

in which $R_1$ and $R_2$ are the same or different and are each alkyl, alkenyl, hydroxyalkyl, hydroxyalkenyl, aminoalkyl or aminoalkenyl, or $R_1$ and $R_2$ together are alkylene, oxyalkylene or aminoalkylene; $R_3$ and $R_4$ are the same or different and are each H, alkyl, alkylaryl or aryl; $R_6$ is alkyl, alkenyl, optionally mono- or polyunsaturated cycloalkyl, aryl, in each case optionally substituted, for example by at least one hydroxyl radical or alkyl radical, or interrupted by at least one heteroatom; A is a straight-chain or branched alkylene radical optionally interrupted by one or more heteroatoms such as N, O and S; and n is an integer value from 1 to 50.

Suitable reaction products of a hydrocarbyl-substituted acylating agent and a compound comprising a nitrogen or oxygen atom and additionally comprising at least one quaternizable, especially tertiary, amino group are known from WO2013/000997. Suitable hydrocarbyl-substituted acylating agents include polycarboxylic acid compounds. The polycarboxylic acid compounds used are aliphatic di- or polybasic (for example tri- or tetrabasic), especially from di-, tri- or tetracarboxylic acids and analogs thereof, such as anhydrides or lower alkyl esters (partially or completely esterified), and is optionally substituted by one or more (for example 2 or 3), especially a long-chain alkyl radical and/or a high molecular weight hydrocarbyl radical, especially a polyalkylene radical. Examples are $C_3$-$C_{10}$ polycarboxylic acids, such as the dicarboxylic acids malonic acid, succinic acid, glutaric acid, adipic acid, pimelic acid, suberic acid, azelaic acid and sebacic acid, and the branched analogs thereof; and the tricarboxylic acid citric acid; and anhydrides or lower alkyl esters thereof. The polycarboxylic acid compounds can also be obtained from the corresponding monounsaturated acids and addition of at least one long-chain alkyl radical and/or high molecular weight hydrocarbyl radical. Examples of suitable monounsaturated acids are fumaric acid, maleic acid, itaconic acid.

The hydrophobic "long-chain" or "high molecular weight" hydrocarbyl radical which ensures sufficient solubility of the quaternized product in the fuel has a number-average molecular weight ($M_n$) of 85 to 20 000, for example 113 to 10 000, or 200 to 10 000 or 350 to 5000, for example 350 to 3000, 500 to 2500, 700 to 2500, or 800 to 1500. Typical hydrophobic hydrocarbyl radicals include polypropenyl, polybutenyl and polyisobutenyl radicals, for example with a number-average molecular weight $M_n$ of 3500 to 5000, 350 to 3000, 500 to 2500, 700 to 2500 and 800 to 1500.

The quaternizable nitrogen compounds reactive with the above polycarboxylic acid compound are selected from a) hydroxyalkyl-substituted mono- or polyamines having at least one quaternized (e.g. choline) or quaternizable primary, secondary or tertiary amino group;
b) straight-chain or branched, cyclic, heterocyclic, aromatic or nonaromatic polyamines having at least one primary or secondary (anhydride-reactive) amino group and having at least one quaternized or quaternizable primary, secondary or tertiary amino group;
c) piperazines.

Suitable quaternizing agents are selected from hydrocarbyl epoxides, such as epoxides of the formula (4)

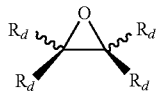

(4)

where the $R_d$ radicals present therein are the same or different and are each H or a hydrocarbyl radical, where the hydrocarbyl radical has at least 1 to 10 carbon atoms. More particularly, these are aliphatic or aromatic radicals, for example linear or branched $C_{1-10}$-alkyl radicals, or aromatic radicals, such as phenyl or $C_{1-4}$-alkylphenyl. Examples of suitable hydrocarbyl epoxides include aliphatic and aromatic alkylene oxides such as, more particularly, $C_{2-12}$-alkylene oxides such as ethylene oxide, propylene oxide, 1,2-butylene oxide, 2,3-butylene oxide, 2-methyl-1,2-propene oxide (isobutene oxide), 1,2-pentene oxide, 2,3-pentene oxide, 2-methyl-1,2-butene oxide, 3-methyl-1,2-butene oxide, 1,2-hexene oxide, 2,3-hexene oxide, 3,4-hexene oxide, 2-methyl-1,2-pentene oxide, 2-ethyl-1,2-butene oxide, 3-methyl-1,2-pentene oxide, 1,2-decene oxide, 1,2-dodecene oxide or 4-methyl-1,2-pentene oxide; and aromatic-substituted ethylene oxides such as optionally substituted styrene oxide, especially styrene oxide or 4-methylstyrene oxide.

Suitable free hydrocarbyl-substituted polycarboxylic acid are free hydrocarbyl-substituted unsaturated, especially saturated, optionally substituted, especially unsubstituted, protic acids such as, more particularly, hydrocarbyl-substituted dicarboxylic acids, especially hydrocarbyl-substituted $C_3$-$C_{26}$ or $C_3$-$C_{12}$ dicarboxylic acids, especially unsubstituted saturated $C_3$-$C_6$ dicarboxylic acid. Suitable dicarboxylic acids here are saturated acids such as malonic acid, succinic acid, glutaric acid, adipic acid, pimelic acid, suberic acid, azelaic acid, sebacic acid, undecanedioic acid and dodecanedioic acid, or higher molecular weight acids, such as tetra-, hexa- or octadecanedioic acid; substituted acids, such as malic acid, α-ketoglutaric acid, oxaloacetic acid; glutamic acid; aspartic acid; and unsaturated acids, such as maleic acid and fumaric acid; such as, more particularly, malonic acid, succinic acid, glutaric acid, adipic acid and pimelic acid. Additionally suitable are aromatic dicarboxylic acids, for example phthalic acid. If required or desired, it is also possible to use hydrocarbyl-substituted dicarboxylic acids in their anhydride form. For the quaternization, the ring opening of the anhydride is then brought about by addition of water.

The hydrocarbyl-substituted dicarboxylic acids can be prepared by hydrolysis of the corresponding hydrocarbyl-substituted dicarboxylic anhydrides in a manner known in principle, as described, for example, in DE 2443537. The hydrolysis is preferably conducted with stoichiometric amounts of water at temperatures of 50 to 150° C., but it is also possible to use an excess of water. The hydrolysis can be conducted without solvent or in the presence of an inert solvent. Typical examples are, for example, solvents from the Solvesso series, toluene, xylene or straight-chain and branched saturated hydrocarbons such as paraffins or naphthenes. The solvent can be removed after the hydrolysis, but preferably remains, and is used as solvent or cosolvent for the subsequent quaternization. Preferred hydrocarbyl-substituted dicarboxylic anhydrides are hydrocarbyl-substituted succinic anhydrides, as sold, for example, by Pentagon: n-dodecenylsuccinic anhydride CAS 19780-11-1, n-octadecenylsuccinic anhydride CAS 28777-98-2, i-octadecenylsuccinic anhydride CAS 28777-98-2, i-hexadecenylsuccinic anhydride/i-octadecenylsuccinic anhydride CAS 32072-96-1 & 28777-98-2, n-octenylsuccinic anhydride CAS 26680-54-6, tetrapropenylsuccinic anhydride CAS 26544-38-7.

The hydrocarbyl substituent of the carboxylic acid is preferably a polyalkylene radical having a polymerization level of 2 to 100, or 3 to 50 or 4 to 25. Additionally preferred is polyisobutene succinic anhydride (PIBSA). The preparation of PIBSA from polyisobutene (PIB) and maleic anhydride (MA) is known in principle and leads to a mixture of PIBSA and bismaleated PIBSA (BM PIBSA, please see scheme 1 below), which is generally not purified but processed further as it is. Especially preferred is PIBSA having a bismaleation level of up to 30%, preferably up to 25% and more preferably up to 20%. In general, the bismaleation level is at least 2%, preferably at least 5% and more preferably at least 10%. Controlled preparation is described, for example, in U.S. Pat. No. 5,883,196. For the preparation, high-reactivity PIB (HR-PIB) having Mn in the range from 500 to 3000, for example 550 to 2500, 800 to 1200 or 900 to 1100 is particularly suitable. Mn is determined by means of GPC as described in U.S. Pat. No. 5,883,196. Particularly preferred PIBSA prepared from HR-PIB (Mn=1000) has hydrolysis numbers of 85-95 mg KOH/g. A nonlimiting example of a particularly suitable PIBSA is Glissopal® SA F from BASF, prepared from HR-PIB (Mn=1000) having a bismaleation level of 15% and a hydrolysis number of 90 mg KOH/g.

It is also conceivable, albeit less preferable, to react the abovementioned hydrocarbyl-substituted dicarboxylic anhydrides not with water but with an alcohol, preferably a monoalcohol, more preferably an alcohol, or an amine to give the corresponding monoester or monoamide of the hydrocarbyl-substituted dicarboxylic acids. What is important is that one acid function remains in the molecule in the case of such a reaction. If the quaternization is conducted in the presence of an alcohol, preference is given to using the same alcohol for such a reaction of the hydrocarbyl-substituted dicarboxylic anhydrides as that used as solvent in the quaternization, i.e. preferably 2-ethylhexanol or 2-propylheptanol, or else butyldiglycol, butylglycol, methoxypropoxypropanol or butoxydipropanol. Such an alcoholysis is preferably conducted with stoichiometric amounts of alcohol or amine at temperatures of 50 to 150° C., but it is also possible to use an excess of alcohol or amine, preferably alcohol. In that case, the latter appropriately remains in the reaction mixture and serves as solvent in the subsequent quaternization.

The emulsifier package may comprise at least one (e.g. one, two or three) nonionic surfactant, preferably at least one nonionic surfactant which is an alkoxylate.

Suitable nonionic surfactants are alkoxylates, alkylglucosides and alkyl polygucosides, or partial esters (such as mono-, di- and triesters) of fatty acids with glycerine or sorbitan (such as glycerine monostearate, sorbitanmonooleat, sorbitantristearat).

Suitable alkoxylates are

- alkoxylated alkanoles, in particular ethoxylated fatty alcohols and ethoxylated oxoalcohols, such as ethoxylated lauryl alcohol, ethoxylated isotridecanol, ethoxylated cetyl alcohol, ethoxylated stearyl alcohol, and esters thereof, such as acetates
- alkoxylated alkylphenols, such as ethoxylated nonylphenyl, ethoxylated dodecylphenyl, ethoxylated isotridecylphenol and the esters thereof, e.g. the acetates
- block-copolymers of ethyleneoxide and propyleneoxide,
- ethoxylated alkylglucosides and alkyl polygucosides,
- ethoxylated fatty amines,
- ethoxylated fatty acids,
- ethoxylated partial esters of fatty acids with glycerine or sorbitan, such as ethoxylated glycerine monostearate
- ethoxylates of vegetable oils or animal fats, such as corn oil ethoxylate, castor oil ethoxylate, tallow oil ethoxylate,
- ethoxylates of fatty amines or of fatty amides.

Preferred nonionic surfactants are ethoxylated fatty alcohols, castor oil ethoxylate and ethoxylates of fatty amides.

Preferably, the alkoxylate is an alkoxylated alkanol. In another form suitable alkoxylates include alkoxylated alkanols, which are usually alkoxylated linear or branched, saturated or unsaturated $C_1$-$C_{20}$ (preferably $C_8$-$C_{20}$) alkanols, preferably ethoxylated, ethoxylated and propoxylated, or ethoxylated and butoxylated, linear or branched, saturated $C_2$-$C_{18}$ (preferably $C_8$-$C_{18}$) alkanols or more preferably, ethoxylated and propoxylated $C_4$-$C_{18}$ (preferably $C_{12}$-$C_{20}$) alkanols. The alkanol unit of the alkoxylated alkanol may be a technical mixture of various chain lengths and isomers. The total number of alkoxy units in the alkoxylated alkanols may range from 5 to 30, preferably from 10 to 25 alkoxy units (e.g. ethyleneoxy and/or propyleneoxy units). The alkoxy units (e.g. EO and PO units) occur preferably in block sequence, in particular as diblock sequence. The polyalkoxylate chain of the alkoxylated alkanols may be terminated by a hydroxy group or a C1 to C4 alkyl, wherein the hydroxy group is preferred. In another form the alkoxy units (e.g. EO and PO units) occur preferably in block sequence, in particular as diblock sequence, and the polyalkoxylate chain of the alkoxylated alkanols is terminated by a hydroxy group.

In another form suitable alkoxylates are alkoxylated alkanols of the formula (I)

$$R^e—O-(AO)_m—R^f \quad (I)$$

in which $R^e$ is straight-chain or branched alkyl or alkylene with from 1 to 32, preferably 4 to 32, more preferably from 10 to 22, carbon atoms, AO is an ethylene oxide radical, propylene oxide radical, butylene oxide radical, pentylene oxide radical, styrene oxide radical or mixtures of the abovementioned radicals in random or block sequence (wherein a diblock sequence is preferred), m is numbers from 1 to 30 and $R^f$ is hydrogen or alkyl with from 1 to 4 carbon atoms.

The alkoxylate may also be an alkoxylate block polymer, which may comprise blocks of polyethylene oxide and polypropylene oxide. The alkoxylate block polymers comprise usually at least 20 wt %, preferably at least 30 wt % of polymerized ethylene oxide. In a preferred form the alkoxylate block polymers comprise at least 10 wt %, preferably at least 15 wt % of polymerized ethylene oxide. The alkoxylate block polymers is preferably a block polymers A-B-A type comprising blocks of polyethylene oxide (block "A") and polypropylene oxide (block "B"). The alkoxylate block polymers are usually terminated on both ends by hydroxyl groups. The molecular weight of the alkoxylate block polymer may be from 1000 to 30000 Da, preferably from 2000 to 15000 Da.

Preferably, the emulsifier package comprises at least two nonionic surfactants which are alkoxylates selected from ethoxylates of fatty amide, castor oil ethoxylate, ethoxylated fatty alcohol.

For example, the emulsifier package comprises at least two ethoxylated fatty alcohols; or at least two castor oil ethoxylates; or at least an ethoxylate of fatty amide and a castor oil ethoxylate; or at least an ethoxylate of fatty amide and an ethoxylated fatty alcohol.

The emulsifier package may comprise at least 0.5, 1, 2, 3, or 4 wt % of the quaternary ammonium surfactant, such as the epoxide quaternized amine.

The emulsifier package may comprise up to 50, 30, 20, 15, 10, 8, or 7 wt % of the quaternary ammonium surfactant, such as the epoxide quaternized amine.

The emulsifier package may comprise 0.1 to 40, 0.5 to 15, or 1 to 10 wt % of the quaternary ammonium surfactant, such as the epoxide quaternized amine.

The emulsifier package may comprise at least 40, 50, 60, 70, 80 or 85 wt % of the nonionic surfactant.

The emulsifier package may comprise up to 99, 97, 95, 93, or 91 wt % of the nonionic surfactant.

The emulsifier package may comprise 40 to 99, 50 to 95, or 60 to 95 wt % of the nonionic surfactant.

If more than one nonionic surfactant is present the amounts relates to the sum of all nonionic surfactants.

The emulsifier package may comprise at least 20, 40, or 50 wt % of the ethoxylate of fatty amide.

The emulsifier package may comprise up to 85, 75, 70 or 65 wt % of the ethoxylate of fatty amide.

The emulsifier package may comprise 30 to 85, 40 to 80, or 50 to 70 wt % of the ethoxylate of fatty amide.

The emulsifier package may comprise at least 10, 20, or 25 wt % of the ethoxylated fatty alcohol and/or the castor oil ethoxylate.

The emulsifier package may comprise up to 80, 45, or 40 wt % of the ethoxylated fatty alcohol and/or the castor oil ethoxylate.

The emulsifier package may comprise 15 to 50, 20 to 40, or 25 to 35 wt % of the ethoxylated fatty alcohol and/or the castor oil ethoxylate.

The emulsifier package may comprise 0.5 to 30 wt % of the quaternary ammonium surfactant, e.g. the epoxide quaternized amine; and 70 to 99.5 wt % of the nonionic surfactant, e.g. alkoxylates selected from ethoxylates of fatty amide, castor oil ethoxylate, and ethoxylated fatty alcohol.

In another form the emulsifier package may comprise 0.5 to 15 wt % of the quaternary ammonium surfactant, e.g. the epoxide quaternized amine; and 85 to 99.5 wt % of the nonionic surfactant, e.g. alkoxylates selected from ethoxylates of fatty amide, castor oil ethoxylate, and ethoxylated fatty alcohol.

In another form the emulsifier package may comprise 0.5 to 10 wt % of the quaternary ammonium surfactant, e.g. the epoxide quaternized amine; and 90 to 99.5 wt % of the nonionic surfactant, e.g. alkoxylates selected from ethoxylates of fatty amide, castor oil ethoxylate, and ethoxylated fatty alcohol.

The emulsifier package may comprise 0.5 to 30 wt % of the epoxide quaternized amine; and 70 to 99.5 wt % of at least one nonionic surfactant which is an alkoxylates, e.g. alkoxylates selected from ethoxylates of fatty amide, castor oil ethoxylate, and ethoxylated fatty alcohol.

In another form the emulsifier package may comprise 0.5 to 15 wt % of the epoxide quaternized amine; and 85 to 99.5 wt % of at least one nonionic surfactant which is an alkoxylates, e.g. alkoxylates selected from ethoxylates of fatty amide, castor oil ethoxylate, and ethoxylated fatty alcohol.

The emulsifier package may comprise 0.5 to 30 wt % of the epoxide quaternized amine; and 70 to 99.5 wt % of at least two nonionic surfactants which are alkoxylates selected from ethoxylates of fatty amide, castor oil ethoxylate, and ethoxylated fatty alcohol.

In another form the emulsifier package may comprise 0.5 to 15 wt % of the epoxide quaternized amine; and 85 to 99.5 wt % of at least two nonionic surfactants which are alkoxylates selected from ethoxylates of fatty amide, castor oil ethoxylate, and ethoxylated fatty alcohol.

In another form the emulsifier package may comprise 0.5 to 30 wt % of the quaternary ammonium surfactant, e.g. the epoxide quaternized amine; and 40 to 80 wt % of the ethoxylate of fatty amide; and 10 to 50 wt % of the ethoxylated fatty alcohol and/or the castor oil ethoxylate.

In another form the emulsifier package may comprise 0.5 to 15 wt % of the quaternary ammonium surfactant, e.g. the epoxide quaternized amine; and 50 to 70 wt % of the ethoxylate of fatty amide; and 20 to 40 wt % of the ethoxylated fatty alcohol and/or the castor oil ethoxylate.

The emulsifier package is usually a liquid at 20° C.

The emulsifier package is may comprise at least 40, 50, 60, 70, 80 or 90 wt % of the sum of all quaternary ammonium surfactants and the nonionic surfactants.

The emulsifier package may comprise polyisobutene based additives, such as reaction products of polyisobutene succinic anhydride with alkylene amines, or quaternized detergents obtainable from quaternizing the above-mentioned reaction products of polyisobutene succinic anhydride with alkylene amines bearing one amino group capable of condensing with the polyisobutene succinic anhydride and one tertiary amino group. The emulsifier package may comprise at least 1, 5, 10 or 15 wt % of the polyisobutene based additives. The emulsifier package may comprise up to 70, 60, 55, 50, 40, 30 or 20 wt % of the polyisobutene based additives.

Suitable polyisobutene based additives are reaction products of polyisobutene succinic anhydride with alkylene amines. In one preferred embodiment the alkylene amines may be oligo ethylene amines, preferably diethylene triamine, triethylene tetramine, tetraethylene pentamine, pentaethylene hexamine, or mixtures thereof. Suitable examples are disclosed in WO 14/184066, especially component (C) and page 9, line 32 to page 19, line 12, which is incorporated herein by reference. In one preferred embodiment the alkylene amines may be alkylene amines bearing one amino group capable of condensing with the polyisobutene succinic anhydride and one tertiary amino group. Suitable examples are disclosed in WO 2010/132259 A1, paragraph [0027] with 3-dimethylaminopropylamine being particularly preferred. In the reaction product such alkylene amines may in a major amount be bound via an amide group, as described in NO 2010/132259 A1, especially as in Preparatory Material A described therein, or via an imide group, as described in WO 2006/135881 A2, especially Preparatory Material A described therein.

Further suitabel polyisobutene based additives are quaternized detergents obtainable from quaternizing the above-mentioned reaction products of polyisobutene succinic anhydride with alkylene amines bearing one amino group capable of condensing with the polyisobutene succinic anhydride and one tertiary amino group. The quaternizing agent may be selected from the group consisting of dialkyl sulfates, benzyl halides, hydrocarbyl substituted carbonates, and hydrocarbyl epoxides in the presence or absence of an acid or mixtures thereof, with hydrocarbyl epoxides being particularly preferred. Examples are described in WO 2006/135881 A2, WO 2010/132259 A1 or WO 2012/004300 which are incorporated herein by reference. The emulsifier package may comprise an organic solvent, such as hydrocarbons (e.g. aliphatic, aromatic, or mixtures thereof), ethers, ketones, or alcohols (e.g. 2-ethylhexanol, 2-propylheptanol, butyldiglycol, butylglycol, methoxypropoxypropanol or butoxydipropanol). Preferred organic solvents are alcohols and hydrocarbons.

The emulsifier package may comprise up to 20, 15, or 10 wt % of the organic solvent, such as 0.5 to 15 or 1 to 10 wt %.

The fuel or the emulsifier package may comprise further additives, such as carrier oils, cold flow improvers, lubricity improvers, corrosion inhibitors, dehazers, antifoams, cetane number improvers, combustion improvers, antioxidants or stabilizers, antistats, metallocenes, metal deactivators, and/or dyes. The fuel or the emulsifier package may comprise up to 50, 30, 10, 5, or 1 wt % of further additives. The emulsifier package may be free of further additives.

The fuel emulsion comprises the emulsifier package in an amount of up to 5, 3, 2, 1, 0.8, 0.6, 0.4, or 0.3 wt % based on the diesel.

The fuel emulsion comprises the emulsifier package in an amount of 0.001 to 1.0 wt %, 0.01 to 0.5 wt % or 0.05 to 0.3 wt % based on the diesel.

The fuel emulsion comprises the emulsifier package in an amount of up to 2, 1, 0.5, 0.2, 0.1, 0.08 wt % based on the fuel emulsion.

The fuel emulsion comprises the emulsifier package in an amount of 0.001 to 0.5, 0.005 to 0.15, or 0.02 to 0.08 wt % based on the fuel emulsion.

The invention further relates to a method for powering a diesel engine with a fuel emulsion comprising the step of preparing the fuel emulsion by emulsifying the fuel and the water in the presence of the emulsifier package.

The powering of a diesel engine with a fuel emulsion is known. Suitable diesel engines are for example a large turbocharged two-stroke diesel engine (e.g. as described in WO 2010/145652 or NO 2010/105620) or a two-strock diesel engine (e.g. as described in DE 19747247 or DE 19747240). The diesel engine may be used for stationary land engines (generators), railroad locomotives, cars, trucks, river ships, or ocean ships. The large two-stroke diesel engines may be used as prime mover in power plants or in ocean ships.

The emulsifying of the fuel and the water may be achieved by application of mechanical shear energy, e.g. in a stirred vessel, milling aggregates (like ball mills or stirred ball mills), shaking, rotor stator mixing, the turbulent flow through a pipe conveyed by pumps or by gravity, static mixers and counter current flow mixers. The emulsifying of the fuel and the water may also be achieved by a circulating the fuel and the water through a loop, e.g. by pumping them from the bottom of a tank to the top of the tank, where they are dumped on the surface of the tank content. Prior to the circulating of the fuel and the water a pre-stirring is possible, but not required.

The emulsifer package may contain different components, such as the quaternary ammonium surfactant, a first nonionic surfactant and a second nonionic surfactant. For emulsifying the fuel and the water some components may be added to the fuel and some components may be added to the water prior to emulsifying. Thus, the different components of the emulsifier package may be combined during the preparing of the fuel emulsion. Preferably, all components of the emulsifer package are premixed prio to emulsifying. Preferably, all components of the emulsifer package are added at the same time to the fuel or the water prior to emulsifying. The present invention may also relate to a fuel for powering a diesel engine with a fuel emulsion where the fuel comprises the emulsifier package.

The emulsifying can be made at temperatures of 0 to 100° C., or 10 to 90° C., or 20 to 50° C.

The emulsifying can be made at pressures of 0.5 to 20 bar, or 1 to 10 bar.

The time between the preparation of the fuel emulsion and its combustion in the diesel engine may be below 24 h, 6 h, 1 h, 45 min, 30 min, 15 min, 10 min, 5 min or 1 min.

Various devices for emulsifying the fuel and the water in diesel engines are known, for example from WO 2016/064722. WO 90/12959, U.S. Pat. No. 4,388,893, or WO 00/53916.

EXAMPLES

| | |
|---|---|
| Quat A: | N,N-dimethyl-N-hexydecylamine quaternized with propylene oxide and polyisobutylenesuccinic acid obtained from succinic acid and polyisobutylene (Mn about 1000 g/mol); 50 wt % in 2-ethylhexanol. |

-continued

| | |
|---|---|
| Nonionic A: | ethoxylate of fatty amide from fatty acid and ethanolamine, clear liquid, hydroxyl value about 150 mg KOH/g. |
| Nonionic B: | castor oil ethoxylate, clear liquid, hydroxyl value about 150 mg KOH/g. |
| Nonionic C: | fatty alcohol alkoxylate, solidifcation temperature about 18° C., kinematic viscosity 30 $mm^2/s$ (40° C., ASTM D445). |
| Additive D: | Commercial fuel additive, amines, polyethylenepoly-, reaction products with succinic anhydride polyisobutenyl (40-60 wt %) in C10 hydrocarbons, aromatics (40-60 wt %). |
| Additive E: | Commercial fuel additive, polyisobutylene succinimide of dimethylaminopropyl-amine in 25-50 wt % hydrocarbon solvent. |
| Additive F: | Commercial fuel addtive, polyisobutylene succinamide of dimethylaminopropyl-amine. |
| Additive G: | Commercial diesel addtive, propoxylated polyisobutylene succinamide of dimethylaminopropylamine |
| Solvent A: | C11-14 Hydrocarbons (n-alkanes, isoalkanes, cyclics and up to 25% aromatics) mixed with nearly 50% C14-18 hydrocarbons (n-alkanes, isoalkanes, cyclics and up to 25% aromatics), clear liquid, boiling range 178-285° C., freeze point below 30° C. |

Example 1—Emulsion Stability

The emulsifier packages were prepared by mixing the emulsifiers as indicated in Table 1 and a liquid mixture of emulsifiers was obtained. The samples for testing the emulsion stability contained diesel fuel and distilled water in a ratio of each 40 ml and the emulsifier package in the given treat rate (cf Table 1). The diesel fuel was a clear liquid, free of additive packages and had a density of about 0.83 to 0.85.

An emulsion was prepared by shaking the samples in a graduated cylinder on a shaker with a lift of 125 mm and a lift speed of 10 lifts for five seconds at 20° C. After the shaking stopped the graduated cylinders were allowed to stand for up to 30 min. The amount of separated water phase was determined. For example, if 8 ml separated water phase was detected in the 80 ml total volume sample, it corresponded to an emulsion stability of 90%. If no separated water phase was detected this corresponded to 100% emulsion stability.

TABLE 1

Emulsion Stability (concentrations in wt %, treat rate in relation to diesel)

| Test | A | B | C | D | E | F Comparative |
|---|---|---|---|---|---|---|
| Nonionic A | 0.06 | 0.09 | 0.15 | 0.065 | 0.065 | 0.067 |
| Nonionic B | 0.03 | 0.045 | 0.075 | 0.03 | — | 0.033 |
| Nonionic C | — | — | — | — | 0.03 | — |
| Quat A | 0.01 | 0.015 | 0.025 | 0.005 | 0.005 | — |
| Treat Rate | 0.1 wt % | 0.15 wt % | 0.25 wt % | 0.1 wt % | 0.1 wt % | 0.1 wt % |
| 1 min | 100% | 100% | 100% | 100% | 100% | 100% |
| 2 min | 100% | 100% | 100% | 100% | 100% | 99% |
| 4 min | 100% | 100% | 100% | 100% | 100% | 91% |
| 6 min | 100% | 100% | 100% | 98% | 100% | 88% |
| 8 min | 100% | 100% | 98% | 90% | 100% | 83% |
| 10 min | 100% | 100% | 94% | 88% | 99% | 78% |
| 15 min | 100% | 100% | 91% | 81% | 94% | 68% |
| 20 min | 100% | 100% | 88% | 75% | 89% | 63% |
| 30 min | 100% | 100% | 70% | 70% | 95% | 58% |

Example 2—Corrosion Protection on Steel

An emulsifier package EP-1 was prepared by mixing 10 wt % Quat A, 60 wt % Nonionic A. and 30 wt % Nonionic C.

The corrosion protection properties of the emulsifier package EP-1 on steel was tested according to DIN ISO 7120 A. The marine diesel had a density at 15° C. of about 890 $kg/m^3$, viscosity of about 7 mm2/s (ISO 3104 at 40° C.) and sulphur content of about 0.2 wt %. The samples contained marine diesel and distilled water in a weight ratio of 50:50 and optionally the emulsifier package EP-1 in a treat rate of 0.1 wt % based on the marine diesel. A cylindrical steel finger was immersed for 24 h at 60° C. and then observed for of rusting.

The steel finger immersed in the emulsion without EP-1 showed clear signs of rusting. The steel finger immersed in the emulsion with the EP-1 showed no signs of rusting. Thus, the emulsifier package reduced the corrosion.

Example 3—Corrosion Protection on Copper

The corrosion protection properties of the emulsifier package EP-1 on copper was tested according to DIN ISO 2160 A. The samples contained marine diesel as in Example 2 and destilled water in a weight ratio of 50:50 and optionally the emulsifier package EP-1 in a treat rate of 0.1 wt % based on the marine diesel. A copper plate was immersed for 3 h at 80° C. and then observed for of rusting.

The copper plate immersed in the emulsion without the emulsifer package showed clear signs of rusting. The copper plate immersed in the emulsion with the emulsifer package showed no signs of rusting. Thus, the emulsifier package reduced the corrosion.

Example 4—Prevention of Precipitate 40 ml Marine diesel as used in Example 2 was mixed with 40 ml destilled water and optionally mixed with the emulsifier package EP-1. A black precipitate formed immediately in the samples, which was filtered off through a paper filter (Macherey-Nagel MN 126/70, thickness 0.2 mm, weight 70 $g/m^2$). After 24 h the amount of residue on the paper filter was determined.

The sample without the emulsifer package resulted in 36.8 g wet filter residue filtration. The sample with the emulsifer package resulted in only 5.5 g wet filter residue.

Thus, the emulsifier package reduced the amount of precipitate and improved the filterability.

Example 5—Additive Packages

The emulsifier packages were prepared by mixing the emulsifiers as indicated in Table 2 and a liquid mixture of emulsifiers was obtained.

The samples for testing the emulsion stability were prepared by mixing the additive package with diesel fuel. The amount of emulsifier used was 0.05% based on total volume of emulsion, including fuel and water, for all experiments in table 2.

The used diesel fuel was a marine diesel oil of the type DMA according to DIN ISO 8217 a clear liquid diesel, free of additive packages and had a density of about 0.83 to 0.85.

The emulsion was prepared with a Silverson L5 high shear lab emulsifier based on rotor-stator principle within 10 sec at 7500 rpm at room temperature.

Then the emulsified samples were put in a graduated cylinder which was allowed to stand for up to 30 min. The amount of separated water phase was determined. For example, if 8 ml separated water phase was detected in the 80 ml total volume sample, it corresponded to an emulsion stability of 90%. If no separated water phase was detected this corresponded to 100% emulsion stability. The values are given in Table 2.

TABLE 2

Additive Packages (all amounts in wt %) and Emulsion stability

| | A | B | C | D | E | F | G | H | I | J | K |
|---|---|---|---|---|---|---|---|---|---|---|---|
| Nonionic C | 30 | 24 | 12 | 6 | 3 | 15 | 7.5 | 15 | 24 | 15 | 7.5 |
| Nonionic A | 60 | 48 | 24 | 12 | 6 | 30 | 15 | 30 | 48 | 30 | 15 |
| Quat A | 10 | 8 | 4 | 2 | 1 | 5 | 2.5 | 5 | 8 | 5 | 2.5 |
| Additive D | | 20 | 10 | 80 | 40 | 50 | 25 | | | | |
| Additive E | | | | | | | | 50 | | | |
| Additive F | | | | | | | | | | 50 | 25 |
| Additive G | | | | | | | | | 20 | | |
| Solvent A | | | 50 | | 50 | | 50 | | | | 50 |
| Ratio Fuel:Water | 1:1 | 1:1.4 | 1:1.4 | 1:1.4 | 1:1.4 | 1:1.4 | 1:1.4 | 1:1.4 | 1:1.4 | 1:1.4 | 1:1.4 |
| 1 min. | 99% | 99% | 99% | 99% | 99% | 99% | 99% | 99% | 94% | 96% | 100% |
| 2 min. | 99% | 98% | 99% | 99% | 99% | 99% | 99% | 99% | 86% | 94% | 100% |
| 5 min. | 98% | 98% | 95% | 97% | 97% | 97% | 97% | 99% | 84% | 93% | 98% |
| 10 min. | 93% | 96% | 90% | 95% | 94% | 95% | 95% | 98% | 82% | 89% | 93% |
| 20 min. | 82% | 95% | 82% | 92% | 91% | 94% | 93% | 96% | 73% | 84% | 88% |
| 30 min. | 76% | 93% | 80% | 86% | 88% | 91% | 90% | 95% | 68% | 80% | 77% |

Example 6—Diesel Types

The additive packages were prepared and tested for emulsion stability as in Example 5 with various DMA Diesel types. The results are summarized in Table 3. Tested DMA Marine Diesel Types were:

| | |
|---|---|
| DMA-1: | dark brown, density (15° C.) about 885 kg/m3, kinetic viscosity 4.9 cSt at 40° C., pour point −9° C. |
| DMA-2: | clear, homogenous with colour marker, density (15° C.) about 886 kg/m3, kinetic viscosity 5.1 cSt at 40° C., pour point −21° C. |
| DMA-3: | clear, homogenous with colour marker, density (15° C.) about 865 kg/m3, kinetic viscosity 4.2 cSt at 40° C., pour point −9° C. |
| DMA-4: | light brown, clear, density (15° C.) about 887 kg/m3, kinetic viscosity 6.0 cSt at 40° C., pour point 12° C. |

TABLE 3

Additive Packages (all amounts in wt %) and Emulsion stability

| | A | B | C | D |
|---|---|---|---|---|
| Nonionic C | 15 | 15 | 15 | 15 |
| Nonionic A | 30 | 30 | 30 | 30 |
| Quat A | 5 | 5 | 5 | 5 |
| Additive E | 50 | 50 | 50 | 50 |
| Diesel Type | DMA-1 | DMA-2 | DMA-3 | DMA-4 |
| Ratio Fuel: Water | 1:1.4 | 1:1.4 | 1:1.4 | 1:1.4 |
| 1 min. | 99% | 99% | 99% | 99% |
| 2 min. | 99% | 99% | 99% | 99% |
| 5 min. | 99% | 98% | 98% | 97% |
| 10 min. | 98% | 96% | 96% | 92% |
| 20 min. | 96% | 90% | 94% | 88% |
| 30 min. | 95% | 84% | 89% | 81% |

The invention claimed is:

1. A fuel emulsion for powering a diesel engine, comprising:

water, a fuel, and an emulsifier package, which comprises a quaternary ammonium surfactant and which comprises at least two nonionic surfactants, which are alkoxylates selected from the group consisting of an ethoxylate of fatty amide, castor oil ethoxylate, and ethoxylated fatty alcohol, wherein the fuel emulsion is an oil-in-water emulsion.

2. The fuel emulsion according to claim 1, wherein the emulsifier package comprises at least 60 wt % of the at least two nonionic surfactants.

3. The fuel emulsion according to claim 1, wherein the quaternary ammonium surfactant is a reaction product obtainable by reacting a quaternizable nitrogen compound comprising at least one quaternizable amino group with a quaternizing agent, which converts the at least one quaternizable amino group to a quaternary ammonium group, wherein the quaternizing agent is a hydrocarbyl epoxide in combination with a free hydrocarbyl-substituted polycarboxylic acid.

4. The fuel emulsion according to claim 1, wherein the emulsifier package comprises 1 to 40 wt % of the quaternary ammonium surfactant.

5. The fuel emulsion according to claim 1, wherein the fuel emulsion comprises the emulsifier package in an amount of 0.05 to 0.5 wt %, based on the fuel emulsion.

6. The fuel emulsion according to claim 1, wherein the fuel emulsion comprises 50 to 80 wt % water.

7. The fuel emulsion according to claim 1, wherein the fuel is marine fuel.

8. A method for powering a diesel engine with a fuel emulsion, the method comprising:

preparing the fuel emulsion according to claim 1 by emulsifying the fuel and water in the presence of the emulsifier package, and combusting said fuel emulsion in a diesel engine.

9. The fuel emulsion according to claim 3, wherein the at least one quaternizable amino group is at least one quaternizable tertiary amino group.

10. The fuel emulsion according to claim 1, wherein said fuel is at least one marine fuel selected from the group consisting of Marine gas oil, Marine diesel oil, Intermediate fuel oil, Marine fuel oil, Heavy fuel oil, a Low-sulphur (<0.1%) Marine Gas Oil according to EU Sulphur directive 2005/33/EC, an Ultra-Low-Sulphur Marine Gas Oil, and fuels according to DIN ISO 8217.

11. The fuel emulsion according to claim 1, wherein said fuel is at least one selected from the group consisting of ISO-F-DMX, DMA, DFA, DMZ, DFZ, DFB, ISO-F RMA, RMB, RMD, RME, RMG and RMK.

12. The fuel emulsion according to claim 1, wherein said fuel has a sulfur content of less than 1 wt. %.

13. The fuel emulsion according to claim 1, wherein a water content is at most 80 wt. %.

14. The fuel emulsion according to claim 1, wherein a water content is at least 55 wt. %.

15. The fuel emulsion according to claim 1, wherein a water content is at least 60 wt. %.

16. The fuel emulsion according to claim 1, wherein a water content is at least 70 wt. %.

* * * * *